United States Patent [19]

McRae et al.

[11] Patent Number: 4,743,428

[45] Date of Patent: May 10, 1988

[54] METHOD FOR AGITATING METALS AND PRODUCING ALLOYS

[75] Inventors: Dale L. McRae, Fruitvale; Robert D. H. Willans, Irail; Eric L. Mawer, Fruitvale, all of Canada

[73] Assignee: Cominco Ltd., Vancouver, Canada

[21] Appl. No.: 893,843

[22] Filed: Aug. 6, 1986

[51] Int. Cl.[4] ..... C22C 1/00

[52] U.S. Cl. ..... 420/590; 75/53; 75/61; 75/93 R; 266/204; 266/235; 420/129; 420/513

[58] Field of Search ..... 75/61, 93 R, 53; 420/590; 266/204, 235

[56] References Cited

U.S. PATENT DOCUMENTS

| | | | |
|---|---|---|---|
| 3,567,204 | 3/1971 | Ando | 75/61 |
| 3,972,709 | 8/1976 | Chia | 75/93 R |
| 4,191,563 | 3/1980 | Smartt | 75/130 R |
| 4,298,377 | 11/1981 | Szekely | 75/93 R |

*Primary Examiner*—Peter D. Rosenberg
*Attorney, Agent, or Firm*—Arne I. Fors; Robert F. Delbridge

[57] ABSTRACT

Method and apparatus for the agitation of base metal on alloy melts, and for the agitation and alloying of base metal melts with at least one alloying metal. A rotatable device is suspended in a melt of base metal and the device is rotated to draw at least a partial vortex in the melt. The device comprises a hollow cylinder having an open top and a closed bottom. An array of openings in the cylinder side wall is adapted to allow melt of the base metal to pass through. In the agitation of a base metal or alloy melt, the amount of dross formed on the melt is reduced. In alloying, the at least one alloying metal may be added directly to the melt or may be added in particulate form into the vortex in the device, the latter being particularly useful when the melting point of the alloying metal is higher than that of the base metal or alloy. When added into the device, the openings in the cylindrical wall are adapted to retain the particulates in the device to be washed with base metal until the particulates are substantially dissolved. Alloys produced using the device have narrow standard deviations from their specification. The alloying proceeds more efficiently with formation of less dross and less off-specification material, proceeds faster and in less time than heretofore possible, and allows production on a continuous basis.

11 Claims, 3 Drawing Sheets

METHOD FOR AGITATING METALS AND PRODUCING ALLOYS

BACKGROUND OF THE INVENTION

This invention relates to the treatment of molten metals and, more particularly, to a method and apparatus for agitating molten metal and for incorporating alloying metal into a metal melt.

In the processing of molten metals prior to casting in moulds, molten metal is often held in a vessel such as a mixing furnace or holding vessel. The molten metal in such vessel is usually agitated which results in the formation of an amount of dross. The molten metal is cast as a base metal, or as a base metal alloy after the addition of one or more alloying metals to the melt of base metal. The dross formed in the treatment of molten metal and in the alloying of metals is a disadvantage in that dross must be retreated adding to the cost of the production of metals and alloys.

In the alloying of metals, one or more alloying metals are often added to a bath of molten base metal as elemental metal or master alloy in solid form such as in the form of particulates. In the production of most alloys, however, the alloying does not proceed readily. Such is particularly the case when a base metal is alloyed with alloying metals that have a relatively high melting point compared to that of the base metal. When such high melting alloying metals are added to molten base metal, the rate of dissolution is low and a high temperature increment over the melting temperature of the base metal or the alloy must be provided to increase the rate. In addition, in most cases, the base metal and added alloying metals form semi-plastic masses which are slow to dissolve and which accumulate in the bottom of the alloying vessel. Efforts to accelerate the dissolution by known methods such as vortex, high-velocity, or high-shear mixing are only partly successful, such mixing often also causing formation of considerable amounts of dross. Dross must not only be removed and treated, but also may contaminate the alloy product. Dross formation is aggravated by exposure to oxidizing conditions. As a result of these problems, the alloy products not only have a relatively large standard deviation from the desired composition specification but sometimes do not meet the specification and must be reprocessed. These problems tend to restrict the alloying to more costly batch processes.

SUMMARY OF THE INVENTION

We have now found that the above-stated problems in the processing of metals and alloys may be alleviated by using a specially designed rotating device whereby dross formation is sharply reduced and wherein the alloying metal or metals are virtually completely and uniformly dissolved in the base metal in the rotating device.

The rotating device is submerged in a melt of base metal or alloy flowing through a vessel or mixing furnace. The device is rotated to agitate the melt, any dross formed is removed, and the base metal or alloy is flowed to and solidified in moulds. The use of the device results in the formation of less dross as compared to the use of other agitating devices.

In the alloying of metals, the rotating device is submerged in a melt of base metal or base metal alloy contained in a mixing furnace or an alloying vessel. The device is rotated and alloying metal is added to the vessel, while allowing the melt of base metal or base metal alloy to circulate through the device. In a preferred embodiment, alloying metal is added in particulate form to the rotating device and the alloying metal is essentially retained within the device until virtually dissolved. The use of the rotating device results in formation of less dross and in more efficient and uniform mixing of the alloy components, and yields alloy products that have a lower standard deviation from specification, thereby allowing the continuous production of alloys. The alloying can also be carried out more efficiently at a lower temperature increment and in less time.

Accordingly, it is an object of the present invention to provide a method for agitating molten metals or alloys. It is another object to provide a method for reducing the amount of dross formed during the agitating of molten metals or alloys. It is another object to provide a method for alloying metals with reduced dross formation. It is yet another object to provide a method for alloying metals at an improved rate of dissolution of alloying metal. It is still another object to provide a method for alloying metals resulting in alloy products with a reduced standard deviation from composition specification. It is a further object to provide a rotating device for the alloying of metals. It is yet a further object to provide a rotating device for the agitating of metals and alloys. These and other objects of the present invention will become clear from the detailed description.

In accordance with the broadest scope of the invention, there is provided a method for the agitation of a melt of a base metal or alloy which comprises the steps of establishing a melt of base metal or alloy in a vessel; submerging a rotatable device in said melt, said rotatable device comprising a hollow cylinder having a side wall with an upper end and a lower end, said cylinder being open at the upper end and closed at the lower end, said side wall having an array of equispaced openings adapted to allow said melt to pass through said openings, and said cylinder having a diameter relative to the diameter of the vessel in the range of about 1.5:1 to about 3.5:1; rotating said cylinder at a predetermined speed in the range of about 100 to about 600 revolutions per minute sufficient to draw at least a partial vortex in said melt into said rotatable device, causing said melt to flow into the top of said device and out through said side wall openings; and withdrawing melt from said vessel.

According to a first preferred embodiment of the method of the invention, the melt of the base metal is agitated for the alloying of said base metal with at least one alloying metal in said vessel; an amount of said at least one alloying metal is fed into said melt of base metal, said amount being a predetermined amount sufficient to provide an alloy of desired composition; an alloy of said base metal is formed with said at least one alloying metal; and said alloy of desired composition is withdrawn from said vessel.

According to a second preferred embodiment of the method of the invention, wherein the melt of the base metal is agitated for the alloying of said base metal with at least one alloying metal, at least one alloying metal is fed in particulate form into said vortex in said device in a predetermined amount sufficient to provide an alloy containing the desired amount of said at least one alloying metal fed in particulate form into said vortex in said device; said openings in said cylindrical wall are adapted to retain alloying metal added in particulate form in said device; said alloying metal added to said device is washed in said device with said melt of base metal while rotating said device, said washing with base metal while rotating said device causing dissolution of said alloying metal added to said device and formation of an alloy of said base metal with at least one alloying metal added to said device; and an alloy of desired composition is withdrawn from said vessel.

According to an embodiment of the apparatus of invention, there is provided a rotatable device for the agitation of a base metal or alloy melt and for the alloying of at least one alloying metal with said base metal or alloy melt in a vessel, said rotatable device comprising a hollow cylinder having a side wall with an upper end and a lower end, said cylinder being open at the upper end and closed at the lower end, said side wall having an array of openings formed therein adapted to allow said melt to pass through said openings, said cylinder having a diameter relative to the diameter of the vessel in the range of about 1.5:1 to about 3.5:1; and means attached to said rotatable device for rotating said cylinder at a speed in the range of about 100 to about 600 revolutions per minute whereby at least a partial vortex can be formed in the said melt.

The total surface area of said openings in the rotatable device is in the range of about 2 to 40% of the outside surface area of the cylindrical wall. The openings in the cylindrical wall are of a circular cross-section having a diameter greater than about 3 mm and, preferably in the range of about 3 to 16 mm. Alternatively, the openings in the cylindrical wall are of a rectangular cross-section having a width greater than about 3 mm and, preferably, having a surface area in the range of about 75 to 600 $mm^2$. The direction of the openings in the cylindrical wall may be at an angle in the range of from about 1° to about 40° offset from the radius of the cylindrical wall. The openings in the cylindrical wall may diverge outwardly through the cylindrical wall at an angle in the range of about 1° to about 15°.

BRIEF DESCRIPTION OF THE DRAWINGS

The invention will now be described with reference to the accompanying drawings in which.

DETAILED DESCRIPTION

The method and apparatus of the present invention are suitable for the agitation of melts of base metal and alloys, and for the alloying of one or more alloying metals with a base metal or a base metal alloy. The method and apparatus are particularly suitable for agitating a melt of a base metal or alloy in a vessel prior to its casting, for producing alloys in an alloying vessel, and for producing alloy products wherein at least one of the alloying metals has a melting point that is higher than the melting point of the base metal or base metal alloy. For example, the method and apparatus are useful in the preparation of zinc metal from molten zinc, of zinc alloys, and particularly of alloys of the base metal zinc with alloying metals such as iron, nickel, manganese, aluminum and copper, added alone or together with other alloying metals such as lead, cadmium, misch metal, lanthanum or cerium. It is understood that, although the description is made with specific reference to zinc alloys, the invention is also suitable for application to other base metals or alloys, especially those that require agitation resulting in dross formation, and particularly so in cases wherein at least one of the alloying metals has a melting temperature higher than the melting temperature of the base metal in the alloy being prepared.

Figure 1:
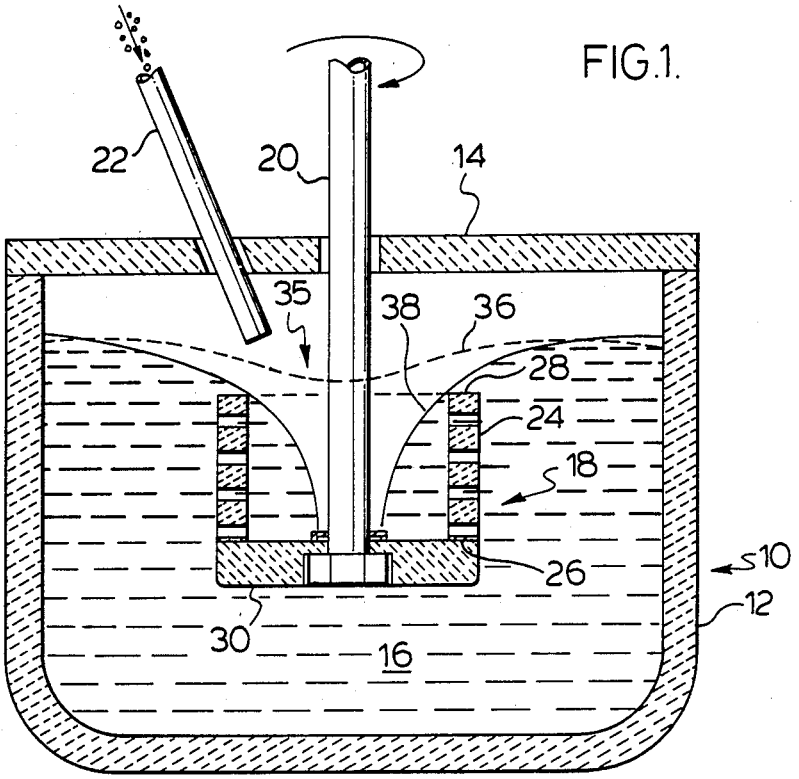
FIG. 1 is a sectional view of a vessel with the rotatable device of the present invention.

With reference to FIG. 1, the apparatus comprises a suitable vessel for containment of molten metal, generally indicated at 10. Vessel 10 comprises a main body 12, wherein the agitating of melts of base metals or alloys, or the alloying of metals is conducted. If desired, vessel 10 maybe provided with a cover indicated at 14. The vessel may have anyone of a number of conventional configurations and is made from known high temperature resistant materials. The vessel may also comprise two or more compartments in series (not shown). For example, when producing alloys, the alloy may be produced in a three-compartment apparatus, wherein the alloy is prepared in a first compartment containing the rotating device (to be described) of the present invention, the alloy is allowed to flow from the first compartment into a second compartment wherein any dross would be separated, and the alloy is then allowed to flow into a third compartment from which the alloy is flowed or pumped into moulds and solidified. Means (not shown) are usually provided to heat vessel 10. Vessel 10 is provided with suitable means (not shown), such as an overflow, a taphole or a pump, for the removal of base metal or alloy from vessel 10. A melt 16 of base metal or base metal alloy is provided in vessel 10. A rotatable device generally indicated at 18 is suspended in melt 16. Rotatable device 18 has a suitable diameter (to be described) and is centrally mounted on a shaft 20 which is affixed to rotatable device 18. Shaft 20 passes through cover 14 and is connected to drive means (not shown) for rotating shaft 20 and affixed device 18. When agitating molten base metal or alloy, molten base metal or alloy is added to vessel 10, preferably separated from any dross that may have formed.

When alloying molten base metal with at least one alloying metal, the alloying metal may be fed directly into melt 16 or into rotatable device 18. When alloying with metals that have a relatively low melting point compared to that of the base metal, the alloying metals can be fed directly into vessel 10 in solid or liquid form. When alloying with metals that have a relatively high melting point, the alloying metals are fed in particulate form into device 18.

Feeding means 22 is provided for feeding alloying metal in particulate form into rotatable device 18. Feeding means 22 passes through cover 14 of alloying vessel 10.

Rotatable device 18 comprises a cylindrical side wall 24 having a bottom 26 and a top 28. Attached to bottom 26 of wall 24 is a bottom plate 30. Device 18 thus has a substantially cylindrical configuration with an open top and a closed bottom. The solid bottom plate 30 closes the bottom of the cylindrical wall and forms a convenient base to which to attach centrally the shaft 20. Shaft 20 may be hollow and may be adapted for feeding a gas, preferably inert, to the base of the device through openings 32 that are provided at its lower extremity, as shown in FIG. 3. Cylindrical wall 24 is provided with an array of openings 34 to be described specifically with reference to FIGS. 2–7. The openings may have anyone of a number of suitable configurations and may have a wide range of total surface areas. The openings conveniently comprise a total surface area in the range of about 2 to 40% of the surface area of the cylindrical wall 24. Device 18 is preferably made of a material resistant to the effects of the melt material such as, for example, silicon carbide, fused silica or other ceramic material, or graphite, and the like.

According to the method of the present invention, molten base metal or alloy melt 16 is added to vessel 10. Rotatable device 18 is suspended and submerged in melt 16 at a convenient depth and rotated by rotating shaft 20 with the external rotating means. The speed of rotation is such that a vortex 35, shown most clearly in FIG. 1, is drawn into the surface of the melt 16. The vortex is at least a partial vortex, i.e. an indentation in the surface of the melt as shown with interrupted line 36 or a vortex drawn onto bottom plate 30 as shown with solid line 38. Satisfactory vortices are drawn, for example, when the rotatable device has a diameter in the range of about 175 to 380 mm and is rotated at speeds in the range of about 100 to 600 revolutions per minute, while the ratio between the diameter of vessel 10 and the diamter of rotatable device 18 is in the range of about 1.5:1 to 3.5:1. The formation of a satisfactory and efficient vortex is accomplished over a range of rotational speeds that is greater than can be obtained with a conventional blade-type mixing device. Rotatable devices having a diameter in the above stated range are suitable for the agitation of base metals or alloys without formation of excessive amounts of dross. Such devices are also suitable to handle the addition of a relatively large addition of alloying metal such as, for example, 5% aluminum to molten zinc. When agitating molten base metal or alloy, the drawing of a partial vortex as indicated at 36 is adequate. The desired degree or depth of the vortex depends also on the alloying metal to be alloyed with the base metal and the amount of alloying metal needed to form the desired alloy. For example, when making zinc-aluminum-alloys, or zinc-aluminum-misch metal alloys, only a partial vortex as shown with line 36 is adequate to yield a homogeneous alloy, while for making zinc-nickel alloys a vortex as shown with line 38 is desirable. A vortex drawn onto the bottom plate 30 of device 18 is also desirable when an inert gas is supplied to prevent oxidation. The gas emanating from holes 32 in the lower extremity of shaft 20 forms a blanket above the melt 16 in vessel 10.

The rotation of device 18 causes a flow of melt 16 to enter the open top of device 18, the flow to pass in a rotating fashion, caused by the vortex, downward through the device and then to pass through the array of openings 34 back into melt 16. When alloying by adding alloying metals into device 18, solid particulates of at least one alloying metal are added into vortex 35 from feeding means 22 at a controlled rate and in a predetermined amount that is sufficient to yield the alloy containing the desired amount of alloying metal added into device 18. Feeding means 22 may include means (not shown) for controlling rate and amount. The alloying metal mixes into the melt of base metal and is dissolved. The configuration of the device 18 and the flow of melt 16 circulating through device 18 cause the alloying metal particles to be substantially retained in device 18. Thus, the alloying metal particulates are immersed in a flow of molten base metal in the device. While being substantially retained, the particles are substantially completely dissolved without segregation occurring and the melt flows out through openings 34 to be mixed further into melt 16 forming alloy of the desired composition. Completion of the dissolution takes place readily in melt 16.

The alloying metal, when added in particulate form, usually forms semi-plastic masses or agglomerates with the melt 16 of base metal in vessel 10. This happens especially when the alloying metal has a melting point that is higher than the melting point of the melt 16 in vessel 10. Without being bound by theoretical explanations, it is thought that the melt and the particulates of the added alloying metal form intermediate, high melting point alloys in the form of semi-plastic masses or agglomerates that accumulate in the device and are very slow to dissolve. The rotating device provides a wall that holds the agglomerates in the device by virtue of the centrifugal force created by the rotation. The openings in the cylindrical wall of the device would provide a means for the agglomerates to pass through, but the agglomerates are generally larger than the openings in the initial stages of the alloying. The more fluid melt forms channels through the agglomerates at each opening and the openings appear to act like a sieve, allowing the melt to pass through and retaining the agglomerates in the device while washing and eroding them until dissolved, and a homogeneous alloy melt of the desired composition is formed.

The semi-plastic masses or agglomerates normally require a high temperature increment over the melting temperature of the base metal or metal alloy. Using the rotatable device 18 of the present invention, the alloying metal added to device 18 is retained in the device and continuously washed by the flow of melt into and out of the device. The continuous washing of the alloying metal causes dissolution of the alloying metal at an increased rate. The alloying may therefore be conducted more efficiently at lower temperatures, i.e. at a smaller temperature increment, and in less time. Besides the obvious savings in energy, the operating at lower temperatures is particularly advantageous, for example, where nickel is to be alloyed with zinc. In the conventional operation of alloying nickel with zinc, a high temperature increment is required. This means that the base metal melt must be supplied to the alloying vessel at a high temperature. This in turn requires operating the zinc melting furnace at a high temperature which causes a rapid deterioration of the furnace lining by the highly fluid molten zinc. By retaining the alloying metal in the rotatable device, the mechanical washing of the nickel by the zinc puts the nickel into solution at lower zinc temperatures which do not adversely affect the furnace lining. In addition, by retaining the nickel in a limited volume, formation of dross is reduced. Another result of using the rotatable device is that the alloy, whether made by feeding alloying metal directly into melt 16 or into device 18, after having been removed from vessel 10, is more homogeneous and contains less contaminants. This translates into an important advantage in that alloy, when produced over a period of time, has a reduce standard deviation from its composition specification. Thus, a higher quality alloy product can be produced consistently.

The production of an alloy product with reduced standard deviation makes it possible to perform the alloying continuously. In continuous alloying operation, base metal melt 16 at the desired temperature is continuously added to vessel 10 in a measured amount and alloy metal particulates are added continuously from feeding means 22 at a predetermined rate and in a predetermined amount into vortex 35 in melt 16 and rotating device 18. Alternatively or in addition, alloying metal may be continuously added directly to the melt, i.e. outside the rotatable device. The level of melt 16 in vessel 10 is maintained substantially constant using a suitable level control system. The level is preferably maintained with a variation not exceeding about 5 mm. A volume of alloy of desired composition is removed continuously from vessel 10. The removed melt is poured into moulds and solidified. The molten alloy may be removed from vessel 10 through a suitably located taphole (not shown) or by means of an overflow or a suitable pump for liquid metal. Alternatively, as described above, vessel 10 may comprise two or more compartments (not shown). For example, the alloy may be produced in a three-compartment apparatus, wherein the alloy is prepared in a first compartment, allowed to flow from the first compartment into a second compartment wherein any dross would be separated, and then allowed to flow into the third compartment from which the alloy is pumped into moulds and solidified.

Figure 2:
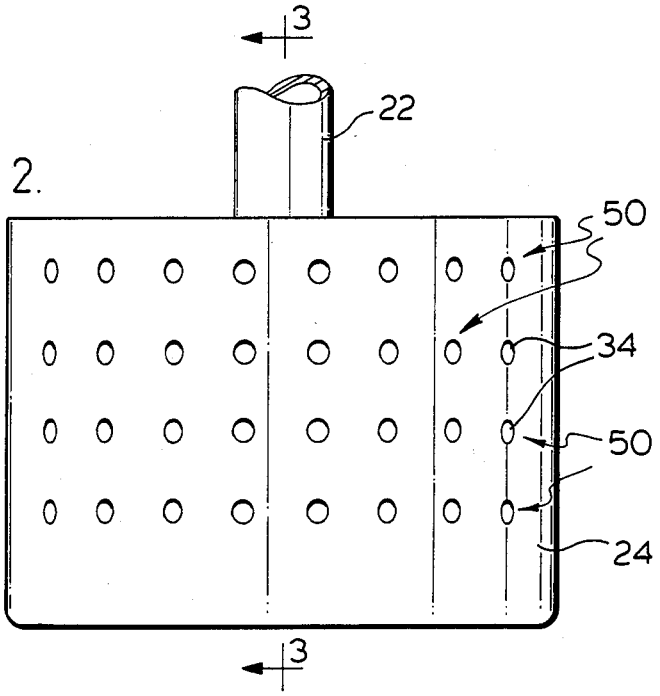
FIG. 2 is a side view of one embodiment of the rotatable device showing an array of circular openings.
Figure 3:
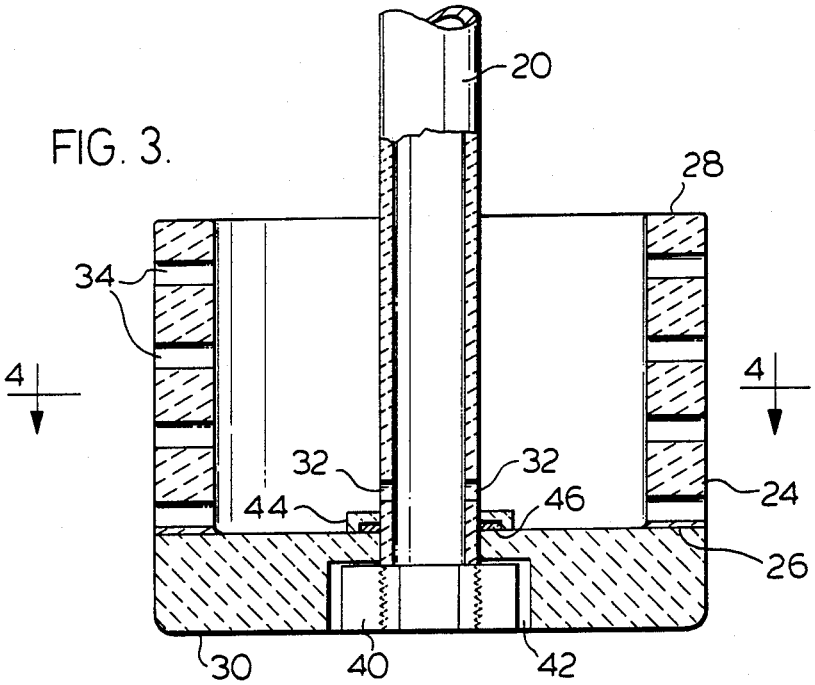
FIG. 3 is a sectional view, partly in perspective, along line 3—3 of FIG. 2 of the rotatable device.

With reference to one preferred embodiment of device 18 as shown in FIGS. 2 and 3, the rotatable device 18 comprises a cylindrical wall 24 having a top 28 and a bottom 26. Attached to bottom 26, or integral with cylindrical wall 24, is a bottom plate 30. Shaft 20 is centrally affixed to device 18 with a nut 40 into inset hole 42 provided in bottom plate 30. Shaft 20 has a peripheral flange 44 which has an inlaid seal 46 by which flange 44 seals onto the top of bottom plate 30. Shaft 20 may be solid, or may be hollow (as shown) and provided with a number of holes 32 at its lower extremity above flange 44 for allowing admission of an inert gas to the rotatable device 18.

Cylindrical wall 24 has an array of openings 34 therein. The openings in the array are circumferentially arranged in radial direction in a number of rows and spaced equidistantly from each other on the outside diameter of cylindrical wall 24. Alternatively, the openings may be arranged on a helix, not shown. As shown in FIG. 2, four rows 50 of round (cylindrical) openings 34 are arranged in radial direction in the cylindrical wall 24. The size of the openings may be larger or smaller than the sizes of the particulates of the alloying metal added to the melt, but the size of the openings is generally smaller than the size of the agglomerates as formed in the melt. Generally, the size of the openings is such that alloying metal added into the device is essentially retained therein until substantially dissolved. Accretions of material tend to occur in the openings but the accretions will eventually be eroded and will disappear. It is, therefore, important that the openings are not so small that plugging occurs or that the flow of melt is too much impeded. On the other hand, the openings should not be so large that agglomerates are not retained before they have been sufficiently dissolved. We have found that, depending on the metals being alloyed, diameters of the openings should be larger than about 3 mm. The openings preferably have a diameter in the range of about 3 to 16 mm.

Figure 4:
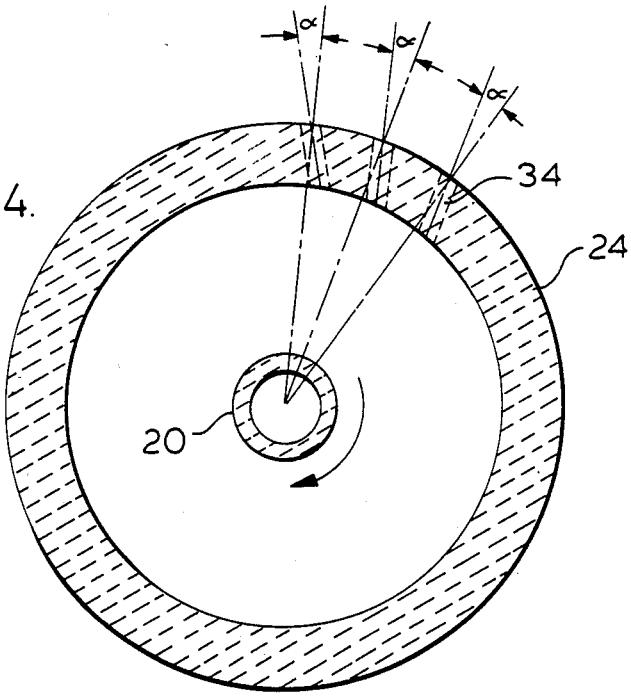
FIG. 4 is a schematical cross-section of the rotatable device through line 4—4 of FIG. 3 showing circular openings off-set at an angle to the radius.

In one modification of the round openings of the device, as shown in FIG. 4, the openings 34 are arranged in an oblique direction, i.e. off-set from the radius of the rotatable device in a direction against the direction of rotation. The angle alpha of the off-set may be in the range of about 1° to about 40°, preferably about 15°. The openings 34 of a circumferential row 50 of openings may, for example, be arranged equidistantly from each other on a 25 mm cord. The off-set of the openings facilitates the ease of flow of the melt through the rotatable device.

If desired, the openings 34 may diverge outwardly through the cylindrical wall 24 at a suitable angle of divergence in the range of about 1° to about 15°. The openings, with an angle of divergence, may decrease blockage if the device is run continuously at or near its maximum capacity.

Figure 5:
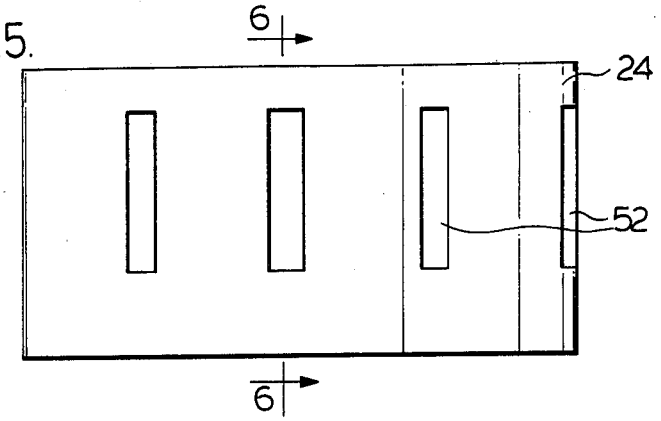
FIG. 5 is a side view of another embodiment of the rotatable device showing an array of rectangular side wall openings.
Figure 6:
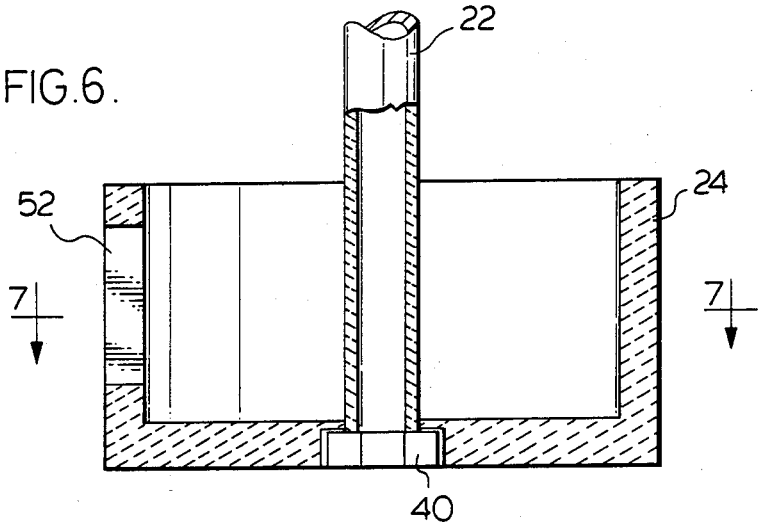
FIG. 6 is a cross-section of the rotable device hollow cylinder of FIG. 5 through line 6—6 showing diverging rectangular openings.

With reference to a second embodiment of device 18 as shown in FIGS. 5 and 6, the rotatable device 18 is provided with an array of openings 52, each opening 52 being arranged circumferentially in a radial direction in cylindrical wall 24 and spaced, preferably, equidistantly from each other. Openings 52 have a usually vertically-positioned, rectangular cross-section. If desired, openings 52 may be positioned at an angle from the vertical such as on a helix, not shown.

Figure 7:
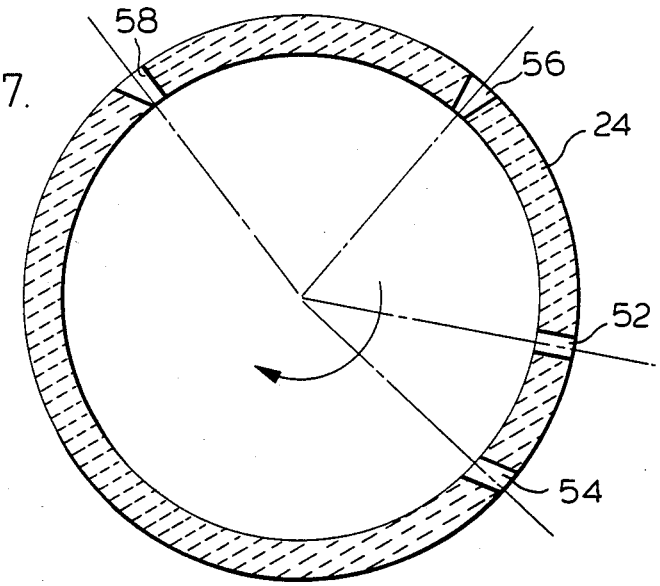
FIG. 7 is a cross-section of the rotatable device through line 7—7 of FIG. 6 schematically showing variations in rectangular openings.

The rectangular openings 52 may have different configurations and/or may be arranged radially or obliquely. For example, several variations are schematically indicated in FIG. 7. Thus, rectangular opening 52 indicates a radial, straight opening, opening 54 indicates a rectangular, straight opening arranged obliquely to the radial; opening 56 indicates a radially-directed, rectangular opening in plane which is outwardly diverging, and opening 58 indicates a rectangular, outwardly diverging opening arranged obliquely to the radial.

The same considerations regarding the size of the openings as given above with respect to circular openings apply to rectangular openings. Each of the rectangular openings 52 and its variations 54, 56 and 58 has a width that is preferably greater than about 3 mm and has a surface area in the range of about 75 to 600 $mm^2$. Each opening has dimensions preferably in the range of about 3 to 12 mm wide and about 25 to 50 mm high. The number of rectangular openings may, for example, be in the range of about eight to sixteen. If arranged obliquely, the angle of off-set from the radius is in the range of about 1° to about 40°. In case the rectangular openings are outwardly divergent, the angle of divergence is in the range of about 1° to about 15°.

The invention will now be illustrated by the following nonlimitative examples.

EXAMPLE 1

A rotatable device was made of graphite. The device had a diameter of 230 mm, a depth of 102 mm, a 25 mm thick solid bottom and four rows of 29 holes, each with a diameter of 8 mm. The holes were arranged equidistantly and at an angle of 15° from the radius. The surface area of the openings was 6.35% of that of the outside surface area of the cylindrical wall. The device was submerged to a depth of 110 mm in a 465 kg charge of molten zinc contained at 525° C. in a heated vessel. The device was rotated at 375 rpm which caused a vortex to be drawn onto the bottom of the device. 9.5 kg of nickel powder, sufficient to yield a zinc alloy with 2% nickel, was added over a period of 2 minutes. After an additional 2 minutes of agitating the alloy melt, the melt was sampled and the sample inspected for nickel. No nickel powder was discernable, as evidenced by SEM examination. True alloying and not blending had occurred. This result demonstrates that nickel can be rapidly alloyed with zinc when added into a rotatable device according to the invention.

EXAMPLE 2

This example illustrates that an alloying metal with a melting point higher than that of a base metal can be incorporated in the base metal using a rotatable device according to the invention at a rate considerably higher than when using a conventional-type mixing device.

In the manufacture of a zinc alloy containing 0.9% copper, copper powder was added to a charge of 498 kg of molten zinc in a vessel. The charge was maintained at 520° C. In a first test, a blade-type mixer was used to agitate the charge and in the second test, a rotatable device according to the invention was used. In both tests, the charge was brought to temperature, rotation of the mixing device started and copper powder was charged into the vortex drawn by the device. The required amount of copper powder was added during the first 15 seconds of mixing. Agitation was continued with a vortex for one minute and was then reduced to a rate at which the surface of the charge was not broken. The charge was sampled after 0.5, 1, 2, 3, 4 and 5 minutes and the samples were analysed for copper. From the results was calculated the fraction of the copper in the melt. Using the blade-type mixer, the melt was found to contain 0.48% copper and using the rotatable device of the invention, the melt was found to contain 0.72% copper. It follows that the amount of copper incorporated into the alloy was accomplished at a rate of 1.9 kg/min when using the conventional blade-type mixer and 3.3 kg/min when using the rotatable device, an increase of 73.7%.

EXAMPLE 3

Two continuous production tests were carried out to determine the comparative performance of a conventional blade-type mixing device and a rotatable device according to the invention. The tests were carried out in a three-compartment furnace, as described, which included a generally circular mixing compartment with a diameter of 457 mm containing a charge of 5000 kg of prime western-grade zinc. To the charge were added lead and aluminum for the production of a zinc-lead-aluminum alloy having a specification of 0.08–0.12% lead, 0.35–0.43% aluminum, balance zinc.

The rotatable device was made of graphite, had a diameter of 178 mm, a height of 127 mm, a depth of 102 mm and contained 84 holes in four rows of 21 equispaced holes, each with a diameter of 8 mm. The total surface area of the openings was 6% of the outside surface area of the cylindrical wall. The holes were obliquely arranged at a 15° angle from the radius against the direction of rotation. The ratio between the diameter of the mixing compartment and that of the device was 2.57. In both tests, lead was added in the form of a 9.5 mm wire at a rate of 0.54 kg/min. Aluminum was added in the form of chopped wire at a rate of 1.77 kg/min. When using the rotatable device, the lead wire was fed directly into the charge outside the device, and aluminum was added to the device into a partial vortex of about 75 mm deep inside the device. The level of the charge in the mixing compartment of the furnace was controlled at a value varying not more than 25 mm. The top of the rotatable device was 100 mm below the level of the melt when stationary. The skimmings were collected for each test from the second compartment of the furnace.

The production was carried out by adding the required weights of alloying metals to a continuous charge of molten zinc, casting 14 ingots of 1088 kg each from the charge of alloy at a rate of 28300 kg/h, and then adding zinc and the required amounts of lead and aluminum to the heel of alloy left in the furnace to produce a new charge of alloy from which 14 ingots were cast. In each test a total of 234,000 kg of alloy was produced.

The alloy was sampled thirty two times just prior to casting and each sample analysed for its lead and aluminum contents. From the analyses results, the standard deviation and the coefficient of variation were calculated. The collected skimmings were weighed and the percentage of weight of skimmings over the total amount of metals processed was calculated. The results are shown in Table I. Also calculated were the recovery of aluminum and lead into the alloy which were 4.0 and 6.9% higher, respectively, with the rotatable device than with the blade-type mixing device.

TABLE I

| Mixing Device | Charge Temp. °C | rpm | % Standard Deviation Pb | % Standard Deviation Al | % coeff. of Variation Pb | % coeff. of Variation Al | Skimmings % |
|---|---|---|---|---|---|---|---|
| blade | 520 | 340 | 0.00775 | 0.01650 | 8.21 | 4.30 | 0.93 |
| rotatable | 499 | 540 | 0.00536 | 0.00875 | 5.32 | 2.22 | 0.71 |

The results show that, compared to a conventional type mixing device, the rotatable device according to the invention yields an alloy that is more homogeneous with a lower standard deviation and with a lower coefficient of variation. The results also show that the alloy can be produced at lower temperatures and with a lower loss in the skimmings or dross, and with a higher recovery of the alloying metals in the alloy.

EXAMPLE 4

A melt of high grade zinc was continuously agitated while flowing through the three-compartment furnace, as described, with a blade-type mixer rotated at 340 rpm in a first test. 69 metric tonnes of zinc flowed through the furnace. The skimmings were collected and calculated to be 0.30% of the zinc flow. In a second test, the blade-type mixer was replaced with a rotatable device of the same dimensions as the one used in Example 3 and rotated at 540 rpm. The skimmings were collected and calculated to be 0.13% of the zinc flow. A third test was carried out with a rotatable device of dimensions similar to those of the device used in the second test, but instead of small holes, the device had an array of slots as shown in FIGS. 5, 6 and 7. The device was made of graphite with an outside diameter of 178 mm, an inside diameter of 140 mm, an overall height of 127 mm and a depth of 102 mm. An array of 16 equispaced slots at 35 mm chords was arranged at 12.7 mm from the inside bottom of the device. Each slot was 60 mm high, 6.3 mm wide on the inside of the device and tapering to a width of 7.9 mm on the outside of the device, and at an oblique, anticlockwise angle of 20°. The total surface area of the slots was 10.8% of the surface area of the inside wall of the device. The rotatable device was rotated at 450 rpm. The result was similar to that of the second test. The results show that the rotatable device can be advantageously used to reduce the amount of skimmings resulting from agitating molten metal.

EXAMPLE 5

Two comparative tests similar to those of Example 3 were done using the same furnace and mixing devices for the production of a zinc-nickel-lead alloy. The alloy specification is 0.45–0.55% nickel, 0.6–1.25% lead, balance zinc. Nickel powder was added at a rate of 1.650 kg/min and lead wire was added at a rate of 2.803 kg/min. When using the rotatable device, the lead wire was added outside the device. During the production of the alloy the furnace temperature varied from 500° to 550° C. The rotatable device was rotated at 540 rpm and the blade-type device at 340 rpm. During production, the alloy was sampled similar to the procedure described in Example 3. The standard deviations were calculated for each test and were found to be 0.0547% when using the blade-type mixer and 0.0308% when using the rotatable device. These results show that the rotatable device yields a more homogeneous alloy with a lower standard deviation.

EXAMPLE 6

Using the rotatable device as used in the test of Example 1, a zinc-base alloy containing aluminum and rare earth metals was continuously produced. The alloy specification is 4.7–5.2% 5.2% Al, 0.02–0.05% La, 0.01–0.04% Ce and the balance zinc.

An alloying furnace with a diameter of 710 mm was charged with 2254 kg of the molten alloy from a previous production run. The alloy contained 4.9% Al, 0.031% Ce and 0.033% La. The rotatable device was immersed in the molten alloy to a depth of 102 mm from the melt surface to the top of the device. The device was rotated at 110 rpm which caused the formation of a partial vortex of 50 mm in the melt surface. Both zinc and aluminum were added into the vortex and into the rotating device in molten form, while the cerium and lanthanum were added as a lanthanum-enriched master alloy of zinc and misch metal containing 10.0% Zn, 26.0% Ce, 39.3% La, 16% Nd and 7% Pr in the form of balls (diameter about 20–25 mm). The temperature of the furnace was maintained at 525° C. The additions of alloying metals were made continuously over three 8 hour periods and the alloy was cast in moulds yielding three lots of alloy. The casting rate for lots 1 and 2 was 5.5 t/h and for lot 3 8.0 t/h. Retention times in the furnace ranged from 11 to 16 minutes. A large number of samples were taken during each 8 hour period and analysed for Al, Ce and La. The size of each lot and the summarized analyses and the statistical data are given in Table II.

TABLE II

| Lot No. | Weight Tonnes | Metal | Analyses high % | low % | mean % | Standard Deviation % | Coeff. of Variation % |
|---|---|---|---|---|---|---|---|
| 1 | 36.8 | Al | 5.2 | 4.8 | 4.9182 | 0.1471 | 2.99 |
| | | Ce | 0.052 | 0.022 | 0.0319 | 0.0085 | 26.20 |
| | | La | 0.045 | 0.028 | 0.0364 | 0.0067 | 18.40 |

TABLE II-continued

| Lot No. | Weight Tonnes | Metal | Analyses high % | low % | mean % | Standard Deviation % | Coeff. of Variation % |
|---|---|---|---|---|---|---|---|
| 2 | 39.5 | Al | 5.2 | 4.6 | 4.9273 | 0.2005 | 4.07 |
| | | Ce | 0.048 | 0.023 | 0.0330 | 0.0086 | 26.10 |
| | | La | 0.043 | 0.022 | 0.0321 | 0.0074 | 23.10 |
| 3 | 51.9 | Al | 5.1 | 4.5 | 4.8524 | 0.1550 | 2.37 |
| | | Ce | 0.043 | 0.022 | 0.0324 | 0.0062 | 19.10 |
| | | La | 0.042 | 0.021 | 0.0338 | 0.0059 | 17.50 |

The recovery rates were calculated at 62% for lanthanum and 92% for cerium.

It follows that a zinc-base alloy containing aluminum and rare earth metals can be made efficiently and continuously using a device according to the invention, and that the alloy can be produced without off-specification material.

What we claim as new and desire to protect by Letters Patent of the United States is:

1. A method for the agitation of a melt of a base metal or alloy whereby dross formation is reduced which comprises the steps of establishing a melt of base metal or alloy in a vessel; submerging a rotatable device in said melt; said rotatable device comprising a hollow cylinder having a side wall with an upper end and a lower end, said cylinder being open at the upper end and closed at the lower end, said side wall having an array of equispaced openings adapted to allow said melt to pass through said openings, and said cylinder having a diameter relative to the diameter of the vessel in the range of about 1.5:1 to about 3.5:1; rotating said cylinder at a predetermined speed in the range of about 100 to about 600 revolutions per minute sufficient to draw at least a partial vortex in said melt into said rotatable device, causing said melt to flow into the top of said device and out through said side wall openings; and withdrawing melt from said vessel.

2. A method as claimed in claim 1, wherein said melt of base metal is agitated for the alloying of said base metal with at least one alloying metal in said vessel; an amount of said at least one alloying metal is fed into said melt of base metal, said amount being a predetermined amount sufficient to provide an alloy of desired composition; an alloy of said base metal is formed with said at least one alloying metal; and said alloy of desired composition is withdrawn from said vessel.

3. A method as claimed in claim 2, wherein said at least one alloying metal is fed in particulate form into said vortex in said device in a predetermined amount sufficient to provide an alloy containing the desired amount of said at least one alloying metal; said openings in said cylindrical wall are adapted to retain alloying metal added in particulate form in said device; said alloying metal added to said device is ashed in said device with said melt of base metal while rotating said device, said washing with base metal while rotating said device causing dissolution of said alloying metal added to said device and formation of an alloy of said base metal with said at least one alloying metal added to said device; and alloy of desired composition is withdrawn from said vessel.

4. A method as claimed in claim 3, wherein the melting point of said at least one alloying metal fed in particulate form into said vortex in said device is higher than the melting point of said base metal.

5. A method as claimed in claim 4, wherein said base metal is zinc and said alloying metal is chosen from the group consisting of iron, nickel, manganese, aluminum and copper.

6. A method as claimed in claim 2, wherein said base metal is zinc, said alloying metal is aluminum and at least one alloying metal chosen from the group consisting of lead, cadmium, misch metal, lanthanum and cerium.

7. A method as claimed in claim 4, wherein said base metal is zinc, said alloying metal is aluminum and at least one alloying metal chosen from the group consisting of lead, cadmium, misch metal, lanthanum and cerium.

8. A method as claimed in claim 3, wherein an inert gas is supplied in said vessel.

9. A method as claimed in claim 3, wherein said alloying is carried out continuously by adding a measured amount of melt of base metal continuously to said vessel, adding said at least one alloying metal continuously to the rotating, rotatable device at a predetermined rate sufficient to produce an alloy of the desired composition, continuously removing a volume of said alloy from said vessel, and maintaining the level of melt in said vessel substantially constant, said alloy removed from said vessel having a small standard deviation from composition specification.

10. A method as claimed in claim 3, wherein said base metal and said alloying metal fed in particulate form form agglomerates and said agglomerates are retained in said device until substantially dissolved.

11. A method as claimed in claim 4, wherein said base metal and said alloying metal fed in particulate form form agglomerates and said agglomerates are retained in said device until substantially dissolved.

* * * * *